US006836202B1

(12) United States Patent
Kim

(10) Patent No.: US 6,836,202 B1
(45) Date of Patent: Dec. 28, 2004

(54) MAGNETIZER HAVING PERMANENT MAGNET IN A SHAPE OF A HEMISPHERE, A HEMISPHERICAL SHELL, OR A SPHERE

(76) Inventor: In-Ku Kim, #206 Kyosoo Apt., San 12-5, Gaeshin-dong, Heungduk-gu, Chungju-shi, Chungchongbukdo 361-240 (KR)

( * ) Notice: Subject to any disclaimer, the term of this patent is extended or adjusted under 35 U.S.C. 154(b) by 0 days.

(21) Appl. No.: 10/797,711

(22) Filed: Mar. 9, 2004

(30) Foreign Application Priority Data

Jul. 29, 2003 (KR) ..... 10-2003-0052480
Nov. 18, 2003 (KR) ..... 10-2003-0081799

(51) Int. Cl.[7] ..... H01F 7/02; H01F 13/00
(52) U.S. Cl. ..... 335/284; 335/302; 335/306
(58) Field of Search ..... 335/284, 302–306; 310/152, 154.21, 156.38

(56) References Cited

U.S. PATENT DOCUMENTS 5,434,462 A * 7/1995 Leupold et al. ..... 310/178
5,666,097 A * 9/1997 Leupold ..... 335/302
6,326,714 B1 * 12/2001 Bandera ..... 310/156.38
6,621,396 B2 * 9/2003 Leupold ..... 335/306

OTHER PUBLICATIONS

Korean Patent Abstract—publication No. 1020000064220, publication date: Nov. 6, 2000 (1 page).
Japanese Patent Abstract—publication 2003–079095, publication date: Mar. 14, 2003 (2 pages).

* cited by examiner

*Primary Examiner*—Ramon M. Barrera
(74) *Attorney, Agent, or Firm*—Morgan & Finnegan, LLP

(57) ABSTRACT

The present invention relates a magnetizer comprising a permanent magnet having a shape of a hemisphere, a hemispherical shell, or a sphere, and more particularly, to a magnetizer comprising a permanent magnet having a shape of a hemisphere, a hemispherical shell, or a sphere capable of eliminating an overhang of a coil. The present invention provides a magnetizer of a DC motor comprising: a case; a hemispherical permanent magnet provided within the case; a non-magnetic member provided below the hemispherical permanent magnet; and a coil provided to the non-magnetic member.

9 Claims, 7 Drawing Sheets

MAGNETIZER HAVING PERMANENT MAGNET IN A SHAPE OF A HEMISPHERE, A HEMISPHERICAL SHELL, OR A SPHERE

FIELD OF THE INVENTION

The present invention relates to a magnetizer comprising a permanent magnet having a shape of a hemisphere, a hemispherical shell, or a sphere, and more particularly, to a magnetizer comprising a permanent magnet having a shape of a hemisphere, a hemispherical shell, or a sphere capable of eliminating an overhang of a coil.

BACKGROUND OF THE INVENTION

In general, a DC motor utilizes a repulsive force and an attractive force generated between a permanent magnet and a coil to which a current is applied. A commutator and a brush are connected to the coil. When a DC voltage is applied through the commutator and the brush to the coil in a magnetic field, the coil is rotated at the clockwise direction according to Fleming's left hand law. Since the commutator and the brush have a function of supplying a unidirectional current to the coil, the coil is rotated at the one direction.

Permanent magnets used for the DC motor may be classified into several types of magnets according to price and material thereof. In addition, methods of magnetization are classified into a unidirectional magnetization and a radial magnetization. In addition, the magnetization can be implemented with multiple poles in some applications. The basic shapes of the permanent magnet include a cylinder, a cylindrical shell, a plate, and a hexahedron.

FIG. 1 is a view illustrating a structure of a conventional DC motor, and FIGS. 2*a* to 2*b* is a view for explaining a structure of a magnetization yoke which is adapted to the conventional DC motor.

As shown in FIG. 1, the DC motor comprises a case 1, a coil 2 which is disposed within the case 1, a permanent magnet 4 which is disposed within the coil2. The permanent magnet 4 has a central shaft 3. A air gap 5 is provided between the coil 4 and the permanent magnet 4.

In FIGS. 2*a* to 2*d*, two types of the conventional DC motors are illustrated according to the types of the permanent magnets. The one type of the permanent magnet shown in FIG. 2*b* in which the magnetic poles are disposed along the up-down direction corresponds to the structure of the magnetizer shown in FIG. 2*a*. The other type of the permanent magnet shown in FIG. 2*d* in which the magnetic poles are disposed along the radial direction corresponds to the structure of the magnetizer shown in FIG. 2*c*.

In these magnetizers, reference numerals 1, 2, and 4 indicate the case, the coil, and the permanent magnet. In addition, reference numeral 6 indicates a non-magnetic member.

The DC motor, in which the magnetizer having one of the two types of the permanent magnets is provided, has a structural characteristic that the DC motor comprises a stator and a rotator, each of which has a cylindrical shape. The structural characteristic results in a problem that the coil has an inevitable end-winding overhang.

The overhang of the coil is never useful in generating a rotational force of the DC motor. Furthermore, the overhang may be a cause of copper loss or the other losses in the DC motor.

SUMMARY OF INVENTION

In order to solve the above mentioned problems, an object of the present invention is to provide a magnetizer comprising a permanent magnet having a shape of a hemisphere, a hemispherical shell, or a sphere capable of eliminating an overhang of a coil.

In order to achieve the object, an aspect of the present invention provides a magnetizer of a DC motor comprising: a case; a hemispherical permanent magnet provided within the case; a non-magnetic member provided below the hemispherical permanent magnet; and a coil provided to the non-magnetic member.

Another aspect of the present invention provides a magnetizer of a DC motor comprising: a case; a hemispherical-shell permanent magnet provided within the case; a non-magnetic member provided below the hemispherical-shell permanent magnet; and a coil provided to the non-magnetic member.

Further another aspect of the present invention provides a magnetizer of a DC motor comprising: a case; a spherical permanent magnet constructed with two hemispherical permanent magnets being arranged to face each other, the spherical permanent magnet being provided within the case; non-magnetic members provided below a upper one and above a lower one of the two hemispherical permanent magnets; and coils provided to the respective non-magnetic members.

In the above aspects of the present invention, the internal portion of the permanent magnet may be the one magnetic pole out of the N and S magnetic poles and the external portion of the permanent magnet may be the other magnetic pole.

In the above aspects of the present invention, the case may be made up of a ferromagnetic material.

In the above aspects of the present invention, distribution of the magnetic field may vary depending on the structure of the non-magnetic member.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Now, the preferred embodiments according to the present invention will be described in detail with reference to the accompanying drawings.

FIG. 3 is a view for explaining a principle of a motor which is adapted to the present invention In general, the following principle is used for changing an electrical energy to a mechanical kinetic energy.

When a current i flows a coil having a length of L under a magnetic field B, a force F which is exerted on the coil is represented by the flowing equation 1.

$$\vec{F}=i\cdot(\vec{L}\times\vec{B}) \qquad \text{[Equation 1]}$$

Figure 1:
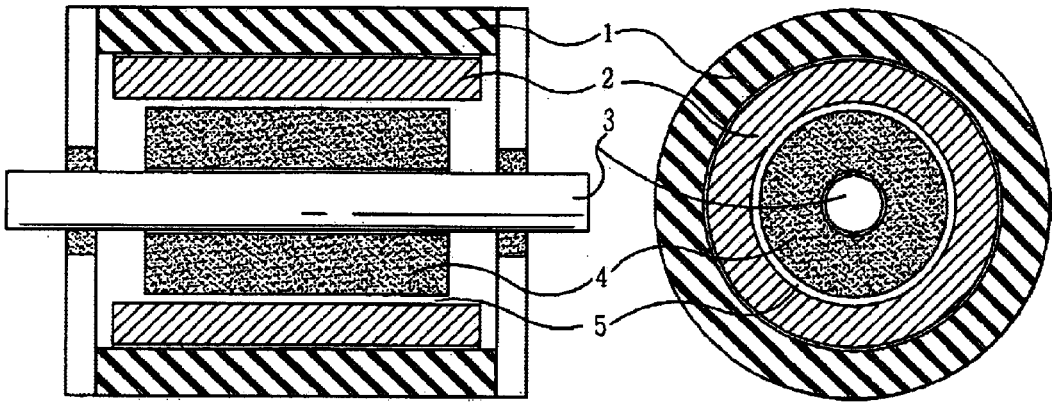
FIG.1 (Prior Art)
FIG. 1 is a view illustrating a structure of a conventional DC motor.
Figure 2A:
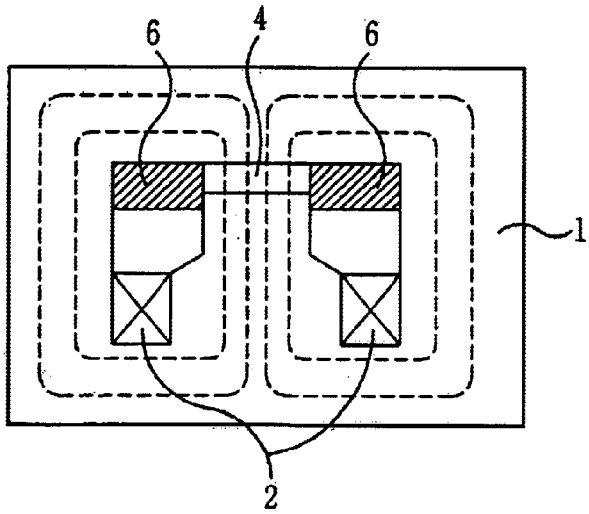
FIG.2a (Prior Art)
FIGS. 2*a* to 2*d* are views for explaining a structure of a magnetization yoke which is adapted to a conventional DC motor.
Figure 2B:
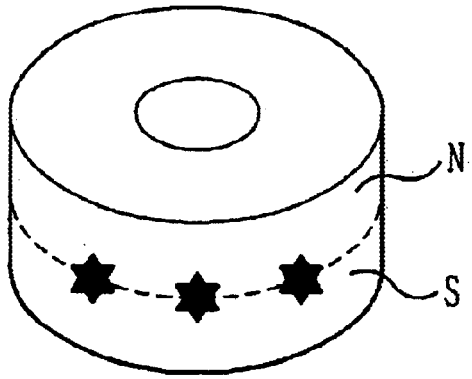
FIG.2b (Prior Art)
Figure 2C:
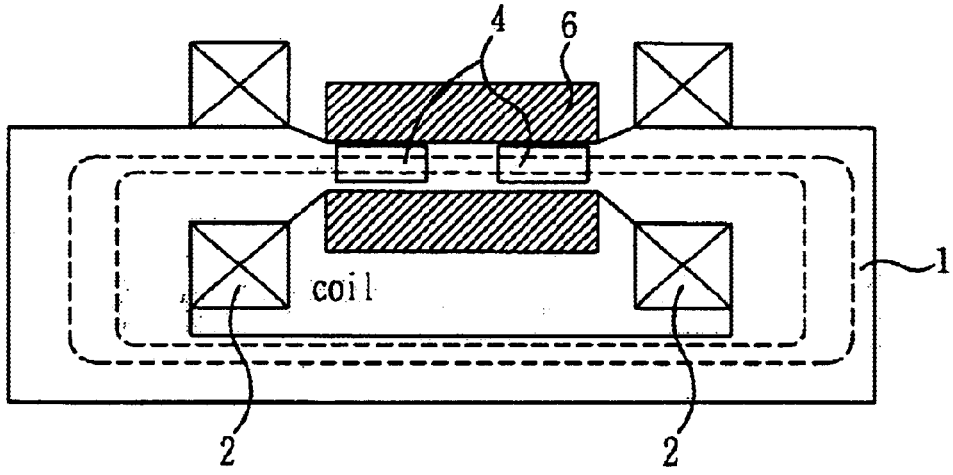
FIG.2c (Prior Art)
Figure 2D:
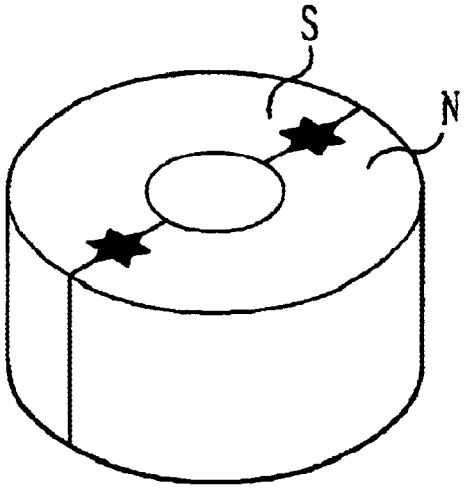
FIG.2d (Prior Art)
Figure 3A:
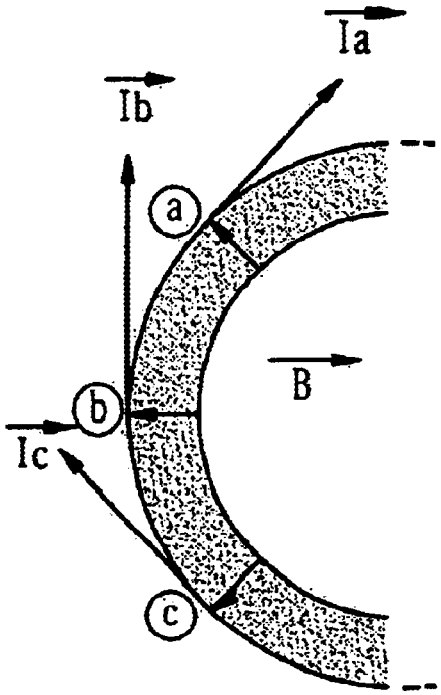
FIG. 3 is a view for explaining a principle of a motor which is adapted to the present invention.
Figure 3B:
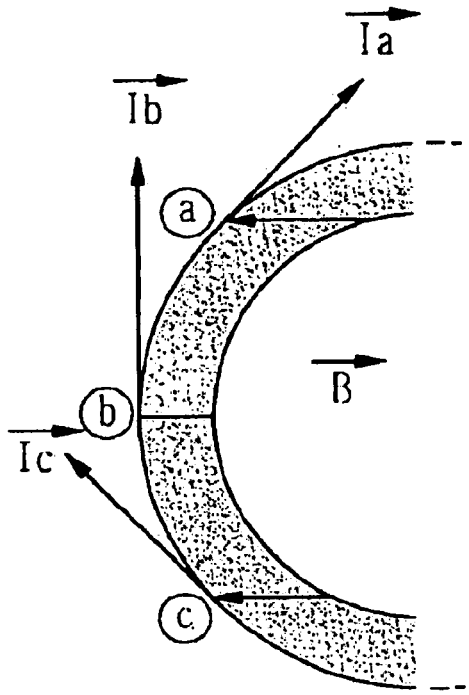

Fore example, in case of a spherical motor, the directions of the current i, the magnetic field $\vec{B}$, and the force $\vec{F}$ at the winding are illustrated in FIGS. 3*a* and 3*b,* which will described later in detail.

1. Force Exerted on a Conductor Line in a Radial-magnetization Motor

Firstly, in a radial-magnetization motor, as shown in FIG. 3*a,* the direction of the current vector $\vec{I}$ which represents a current flowing the winding is the tangential direction of the winding at the points on the winding, for example, the points ⓐ and ⓒ which are located at the same distance from the central shaft. According to Fleming's left hand law, the direction of the force $\vec{F}$ exerted at the point ⓑ is the outgoing direction from the paper plane.

The current vector $\vec{I}_b$ at the point ⓑ is obtained by adding the current vectors $\vec{I}_a$ and $\vec{I}_c$ at the points ⓐ and ⓒ. In the same manner, the current vectors ⓐ and ⓒ are obtained. The direction of the vector which is obtained by adding the current vectors at the points ⓐ, ⓑ and ⓒ is the same as that of the vector $\vec{B}$. Therefore, the force $\vec{F}$ of which direction is the outgoing direction from the paper plane is exerted on the conductor line.

2. Force Exerted on a Conductor Line in a Diametral-magnetization Motor

In a diametral-magnetization motor, as shown in FIG. 3*b,* the direction of the current vector $\vec{I}$ which represents a current flowing the winding is the tangential direction of the winding at the points on the winding, for example, the points ⓐ and ⓒ which are located at the same distance from the central shaft. Similarly to the radial-magnetization motor, according to Fleming's left hand law, the direction of the force $\vec{F}$ exerted at the point ⓑ is the outgoing direction from the paper plane. The current vector $\vec{I}_b$ at the point ⓑ is obtained by adding the current vectors $\vec{I}_a$ and $\vec{I}_c$ at the points ⓐ and ⓒ.

On the other hand, in case of the diametral-magnetization motor unlike the radial-magnetization motor, all the magnetic flux vectors $\vec{B}$ has the same directions at all the points on the winding, for example, the points ⓐ, ⓑ, and ⓒ, and thus all the magnetic flux density vectors $\vec{B}$ are unidirectional.

Magnetic properties of the permanent magnet can be obtained by solving the Maxwell's equations, which are basic equations in the electromagnetism. A magnetic flux density $\vec{B}$ and a vector potential $\vec{A}$ have the relation represented by the following equation 2.

$$\vec{B}=\nabla\times\vec{A} \qquad \text{[Equation 2]}$$

The magnetic flux density $\vec{B}$, a magnetization vector $\vec{M}$, and a magnetic field strength $\vec{H}$ have the relation represented by the following equation 3.

$$\vec{B}\mu_0\vec{H}+\vec{M}=\mu_0\mu_r\vec{H} \qquad \text{[Equation 3]}$$

In case of the diametral-magnetization, a general magnetizer may be used as shown in FIG. 2. In other words, a general permanent magnetizer can be replaced with the permanent magnet having a shape of a sphere or a hemisphere to which the present invention is adapted.

3. Radial Magnetization

On the other hand, the magnetization of a permanent magnetic having a shape of the hemispherical shell is difficult to be incorporated into the general magnetization yoke unlike the diametrical magnetization.

Figure 4:
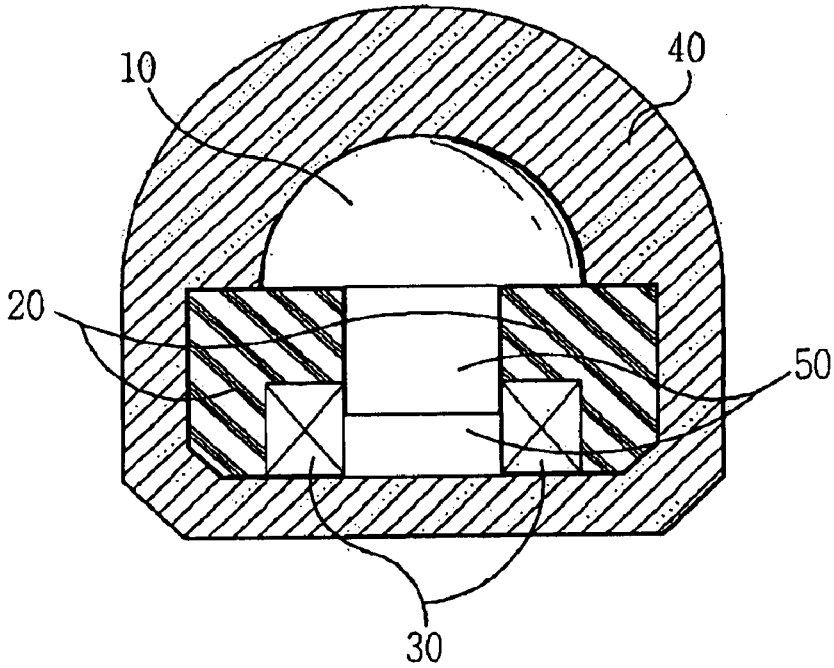
FIG. 4 is a structural plan view of an embodiment of a magnetizer according to the present invention.
Figure 5:
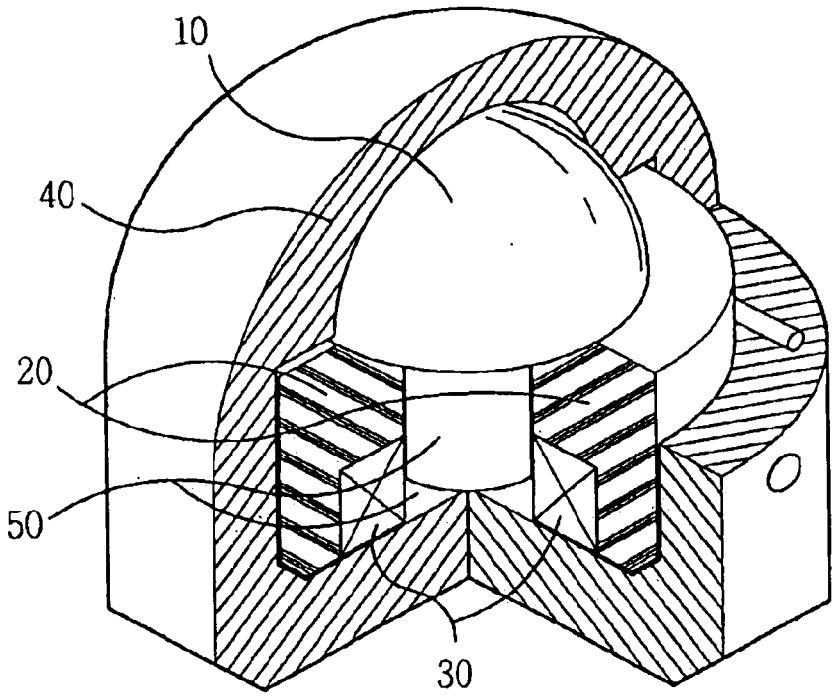
FIG. 5 is a partially sectional perspective view of the embodiment of the magnetizer shown in FIG. 4 according to the present invention.

Therefore, in case of the permanent magnet having a shape of the hemispherical shell according to the present invention, a hemispherical magnetizer shown in FIGS. 4 and 5 is needed.

Namely, a hemispherical permanent magnet 10 is provided within a hemispherical magnetizer case 400. A non-magnetic member 20 is provided below the permanent magnet 10. A coil 20 is provided to the non-magnetic member 20. The case 40 is made up of a ferromagnetic material. In the embodiment, a member 50 is surrounded with the permanent magnet 10, the non-magnetic member 20, and the coil 30. The member 50 is made up of the same material as the case 40.

Figure 6:
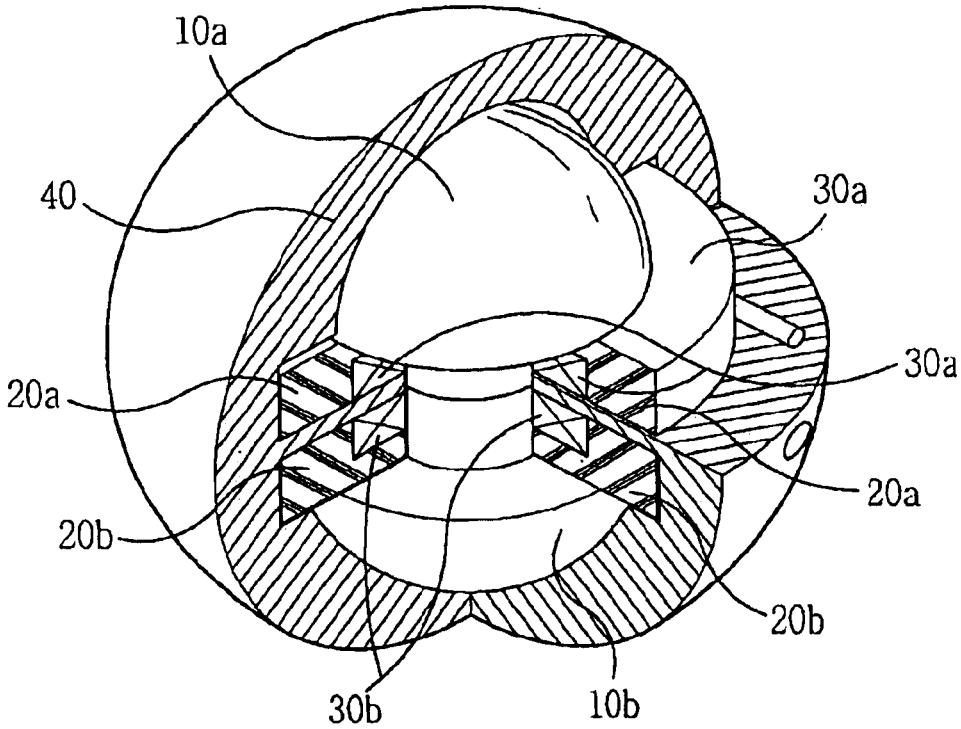
FIG. 6 is a partially sectional perspective view of another embodiment of a magnetizer according to the present invention.

FIG. 6 is a partially sectional perspective view of another embodiment of a magnetizer according to the present invention. In the embodiment, a spherical magnetizer is constructed with two hemispherical permanent magnets which face each other. The spherical magnetizer comprises a case 40, a spherical magnet which is constructed by facing two hemispherical permanent magnets, two non-magnetic members 20*a* and 20*b* which are provided below the hemispherical permanent magnet 10*a* and above the hemispherical permanent magnet 10*b,* respectively, and two coils 30*a* and 30*b* which are provided to the two non-magnetic members 20*a* and 20*b,* respectively. In the embodiment, a member 50 is surrounded with the permanent magnets 10*a* and 10*b,* the non-magnetic members 20*a* and 20*b,* and the coils 30*a* and 30*b*. The member 50 is made up of the same material as the case 40.

In the above mentioned embodiments shown in FIGS. 3 to 7, the internal portion of the permanent magnet is the one magnetic pole out of the N and S magnetic poles and the external portion of the permanent magnet is the other magnetic pole.

4. Simulation

Figure 7:
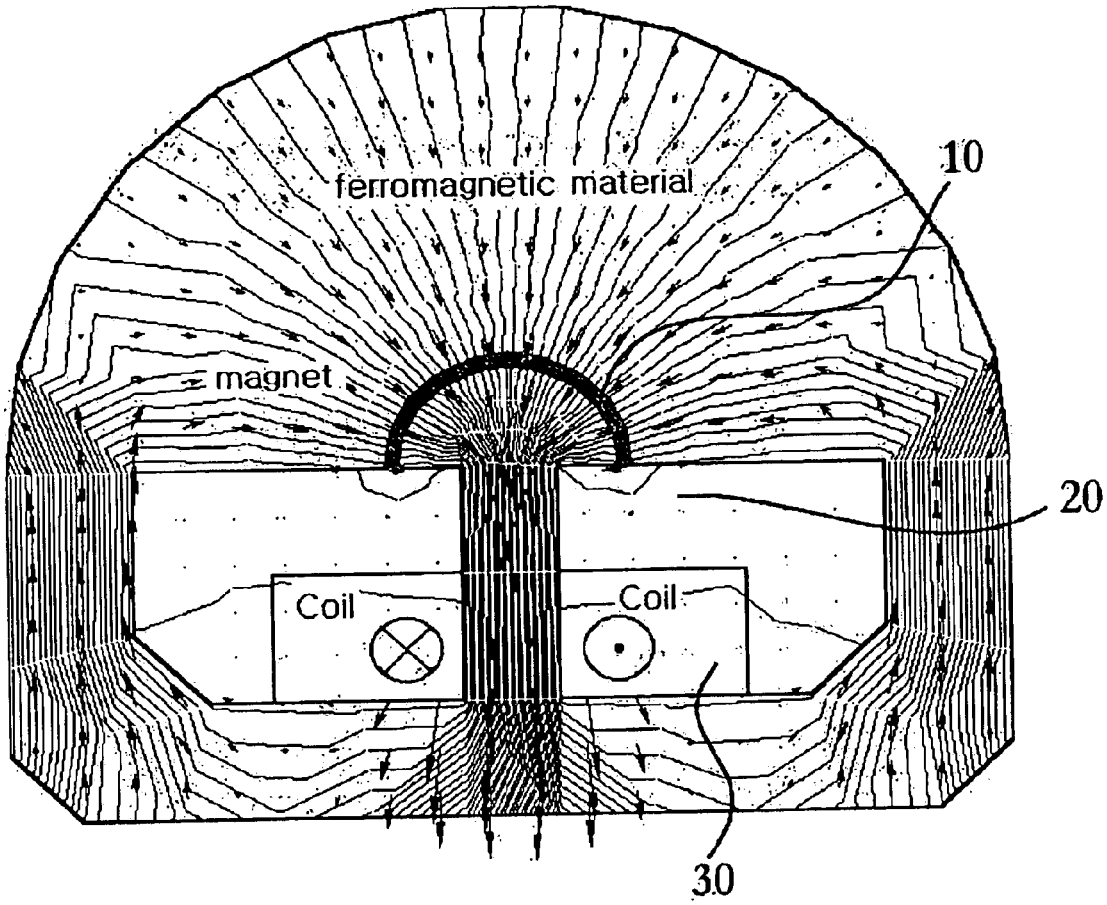
FIG. 7 is a view for explaining a result of a simulation of a magnetizer according to the present invention.

FIG. 7 is a view for explaining a result of a simulation of a magnetizer having a hemispherical-shell magnetization yoke according to the present invention. As shown in FIG. 7, the magnetic flux density has a radial distribution.

Figure 8:
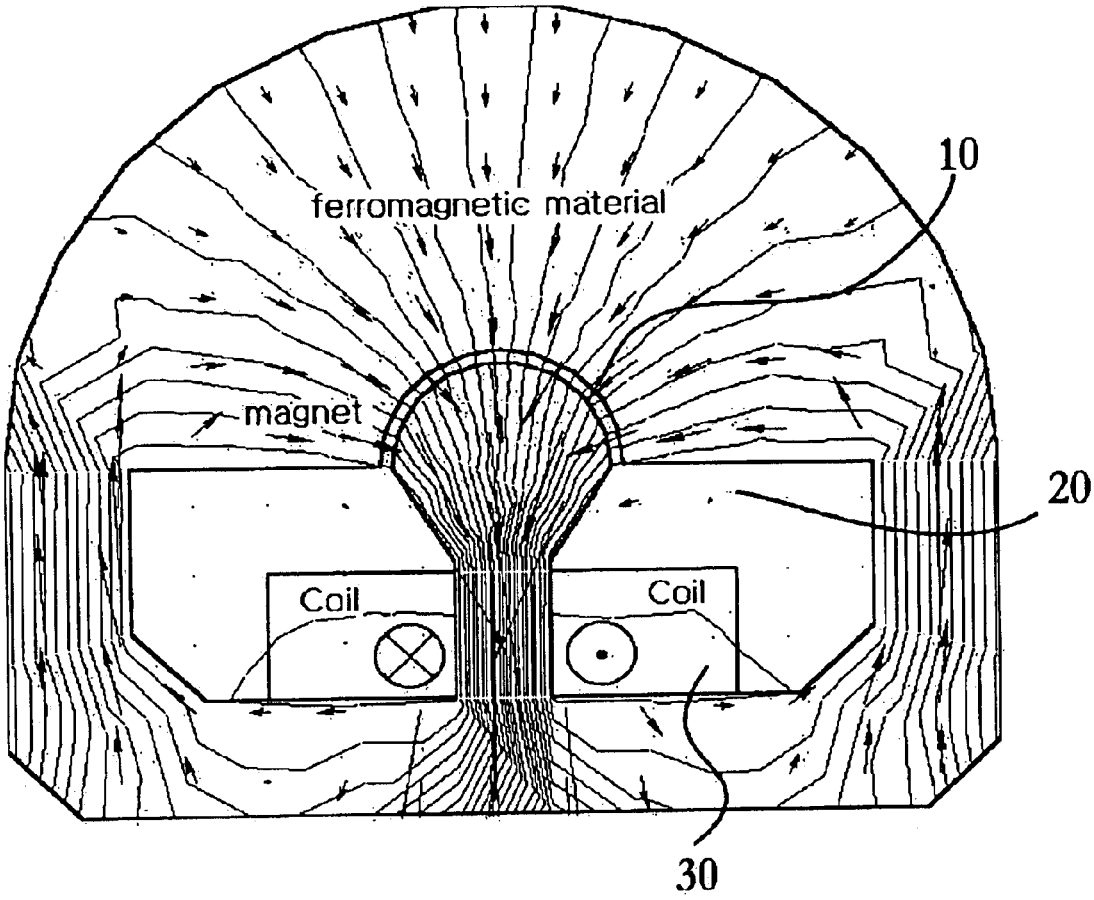
FIG. 8 is a view for explaining a result of a simulation which is obtained in case of changing a structure of a non-magnetic member in the magnetizer of FIG. 7.

Referring to FIG. 8, the distribution of the magnetic field varies depending on the structure of the non-magnetic member 20 at the central portion of the magnetizer. In addition, the magnetic poles N and S are arranged so that the magnetic field can be focused like light rays focused by a convex lens in an optical system.

According to the present invention, it is advantageous that a permanent magnet, which is a requisite component, is formed in a shape of a hemisphere, a hemispherical shell, or a sphere, so that a coil overhang, which occurs in case of cylindrical permanent magnet, can be eliminated.

In addition, according to the present invention, a magnetizer used for a spherical DC motor is constructed with a hemispherical or spherical shell of permanent magnet so that the radial magnetization can be implemented. As a result, it is advantageous that it is possible to reduce copper loss and volume of the magnetizer.

In addition, according to the present invention, it is advantageous that the magnetic field can be focused like light rays focused by a convex lens in an optical system.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A magnetizer of a DC motor comprising:

a case;

a hemispherical permanent magnet provided within the case;

a non-magnetic member provided below the hemispherical permanent magnet; and a coil provided to the non-magnetic member.

2. The magnetizer according to claim 1, wherein the internal portion of the permanent magnet is the one magnetic pole out of the N and S magnetic poles and the external portion of the permanent magnet is the other magnetic pole.

3. The magnetizer according to claim 1, wherein distribution of the magnetic field varies depending on the structure of the non-magnetic member.

4. A magnetizer of a DC motor comprising:

a case;

a hemispherical-shell permanent magnet provided within the case;

a non-magnetic member provided below the hemispherical-shell permanent magnet; and a coil provided to the non-magnetic member.

5. The magnetizer according to claim 4, wherein the internal portion of the hemispherical-shell permanent magnet is the one magnetic pole out of the N and S magnetic poles and the external portion of the hemispherical-shell permanent magnet is the other magnetic pole.

6. The magnetizer according to claim 4, wherein distribution of the magnetic field varies depending on the structure of the non-magnetic member.

7. A magnetizer of a DC motor comprising:

a case;

a spherical permanent magnet constructed with two hemispherical permanent magnets being arranged to face each other, the spherical permanent magnet being provided within the case;

non-magnetic members provided below a upper one and above a lower one of the two hemispherical permanent magnets; and coils provided to the respective non-magnetic members.

8. The magnetizer according to claim 7, wherein the internal portion of the permanent magnet is the one magnetic pole out of the N and S magnetic poles and the external portion of the permanent magnet is the other magnetic pole.

9. The magnetic according to claim 7, wherein distribution of the magnetic field varies depending on the structure of the non-magnetic member.

* * * * *